US006244279B1

(12) United States Patent
Bowden

(10) Patent No.: US 6,244,279 B1
(45) Date of Patent: Jun. 12, 2001

(54) VERTICAL CONVEYOR PARTS WASHER WITH ROTARY CARRIERS

(75) Inventor: Donald R. Bowden, Huntsville, AL (US)

(73) Assignee: Bowden Industries, Inc., Huntsville, AL (US)

( * ) Notice: Subject to any disclaimer, the term of this patent is extended or adjusted under 35 U.S.C. 154(b) by 0 days.

(21) Appl. No.: 09/390,706

(22) Filed: Sep. 7, 1999

(51) Int. Cl.[7] ..... B08B 3/12

(52) U.S. Cl. ..... 134/71; 134/111; 134/126; 134/127; 134/130; 134/134

(58) Field of Search ..... 134/71, 74, 111, 134/126, 127, 130, 134

(56) References Cited

U.S. PATENT DOCUMENTS

| | | | | |
|---|---|---|---|---|
| 736,209 | | 8/1903 | Busch . | |
| 737,195 | | 8/1903 | Barry . | |
| 768,486 | | 8/1904 | Schreiber, Jr. . | |
| 807,687 | | 12/1905 | Schirmer . | |
| 919,796 | | 4/1909 | Volz . | |
| 1,006,410 | | 10/1911 | Schaub . | |
| 1,108,539 | | 8/1914 | Zahm . | |
| 1,381,347 | * | 6/1921 | Evans et al. | 134/126 X |
| 1,864,064 | | 6/1932 | Hall . | |
| 2,025,990 | | 12/1935 | Kokemper . | |
| 2,352,709 | | 7/1944 | Haase . | |
| 2,802,476 | * | 8/1957 | Kearney | 134/74 |
| 3,011,924 | | 12/1961 | Rand . | |
| 3,109,439 | * | 11/1963 | Evans et al. | 134/74 |
| 3,464,428 | | 9/1969 | Kraeft . | |
| 4,651,762 | | 3/1987 | Bowden . | |

* cited by examiner

*Primary Examiner*—Philip R. Coe
(74) *Attorney, Agent, or Firm*—Dowell & Dowell, P.C.

(57) ABSTRACT

A method and system for immersion cleaning of mechanical parts which includes a continuous conveyor having a plurality of vertical conveyor runs which pass through at least one cleaning tank. Each cleaning tank includes at least two turbulent wash zones. Parts carriers are supported by the conveyor such that the parts are rotated as they are conveyed through the at least one cleaning tank during the cleaning process.

20 Claims, 5 Drawing Sheets

Fig. 3
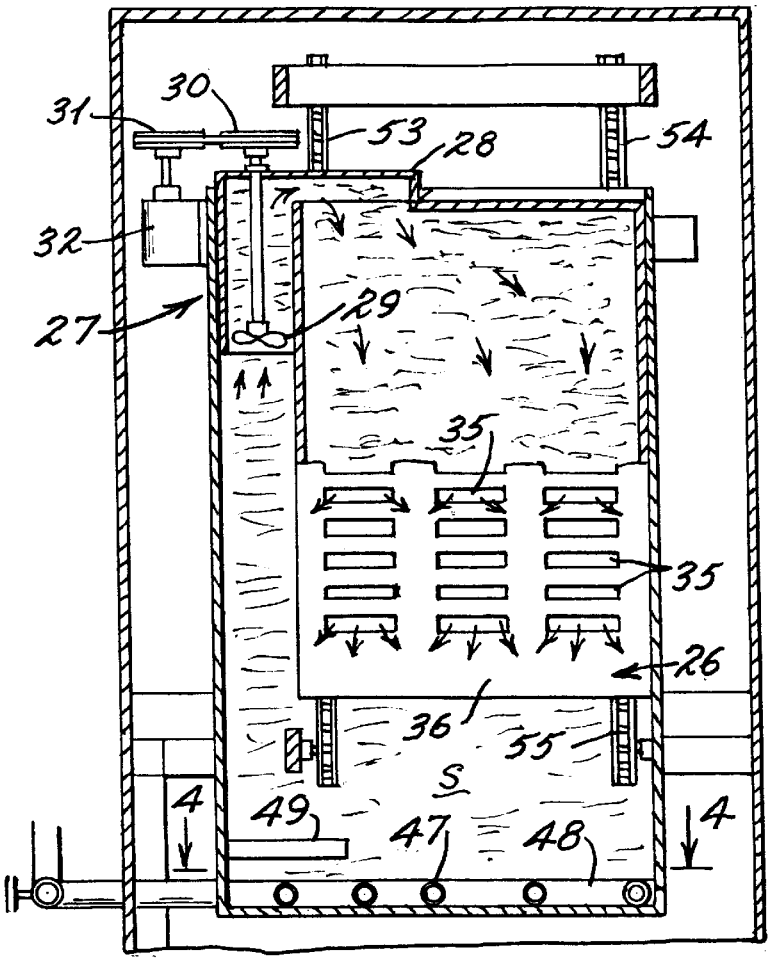
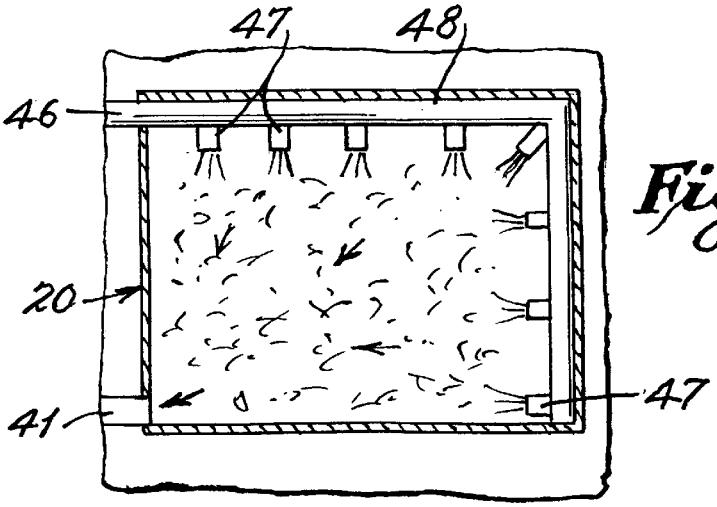
Fig. 4

VERTICAL CONVEYOR PARTS WASHER WITH ROTARY CARRIERS

BACKGROUND OF THE INVENTION

1. Field of the Invention

This invention is generally directed to machines utilized in industry for cleaning mechanical parts and, more particularly, to an immersion parts cleaning system and method for cleaning mechanical parts utilizing a continuous conveyor for carrying the parts from a loading station to a discharge station. The conveyor system includes a plurality of vertical runs which pass through a first washing or cleaning tank in which cleaning solution is injected in a continuous manner to create turbulence for cleaning parts being conveyed therethrough. In some embodiments a second cleaning tank is provided which incorporates an ultrasonic insert for creating shock waves for cleaning parts to ensure complete removal of all oils, particles and other debris. The cleaning systems may also include at least two vertical conveyor runs which pass through a tank in which parts which have been cleaned are thoroughly rinsed, and afterwhich, the parts are dried before being discharged from the system.

2. History of the Related Art

In the manufacturing industry, parts which are machined must be cleaned to remove particles of metal as well as oils, greases and other material associated with a manufacturing process. In other industries, such as where parts are being recycled for further use, built up dirt, tars, grease and other particulate materials must also be removed before the parts can be used. In some parts cleaning systems, parts are conveyed by a conveyor through a spraying system where cleaning solutions or solvents are used to dislodge oils and particles. Unfortunately, the use of spray-type cleaning systems does not adequately remove all particles, oils or other debris from the parts. In addition, such cleaning systems usually require a great deal of floor space within a manufacturing or repair facility thus increasing the initial installation cost of such systems.

An improvement over such spray cleaning systems are immersion systems wherein parts are loaded onto carriers or placed into baskets and are cleaned in a bath of cleaning solution. Each load of parts is immersed into a cleaning solution and the cleaning solution may be agitated to create turbulence to further facilitate the cleansing action of the cleaning agent in removing contaminants from the parts. A draw back associated with such batch-type cleaning processes is that they tend to increase the time required to clean parts which are being manufactured or otherwise recycled for use. Increasing the time of cleaning increases man hours which also increases the cost of the cleaning processes. To overcome this, plants may install a plurality of wash tanks, all of which operate with bulk processes. Although providing a plurality of tanks increases the load capability of the washing system, the increased number of tanks requires additional floor space, and also increases installation and maintenance costs.

In view of the foregoing, there remains a need to provide a very compact immersion-type cleaning system which can be utilized in an environmentally compatible manner within substantially any manufacturing facility such that the system requires a minimum of floor space to be consumed but which functions to provide a continuous cleaning of parts.

SUMMARY OF THE INVENTION

The present invention is directed to a parts cleaning system and method for cleaning mechanical parts which includes a continuous conveyor system having a plurality of vertical conveyer runs and wherein the conveyor system rotates parts within at least one wash tank. Each wash tank includes a cleaning solution through which at least two vertical runs of the conveyor pass. In a first wash tank, a cleaning solution is subjected to turbulent action to enhance the cleaning of the parts being carried therethrough. In a second wash tank, an ultrasonic insert is provided for generating shock waves within a cleaning solution. The at least two vertical runs of the conveyor within each wash tank ensures that the parts are oriented such that opposite sides thereof are directly acted on by the shock waves in the cleaning tank.

In a preferred embodiment, parts which have been carried through at least a turbulent wash tank and an ultrasonic wash tank are thereafter rinsed with the parts being carried along at least two vertical conveyor runs within a rinse tank. After rinsing, the parts are optionally dried as the parts are conveyed to a discharge area of the conveyor.

The turbulent flow wash or cleaning tank includes a fluid discharge header mounted generally centrally thereof. A turbo-charging pump assembly is mounted so as to provide a continuous recycling flow of cleaning solution within the wash tank so that cleaning fluid is forced from the header and directed toward the at least two vertical runs of the continuous conveyor which are situated on opposite sides of the header. The discharge header may include a plurality of nozzles or openings which can be formed so as to create flow at different angles and orientations so that a very turbulent washing action is created in the area of the vertical conveyor runs. The rotation of the parts further facilitates removal of contaminants from the parts.

The cleaning solution within each of the turbulent flow wash tanks and the ultrasonic wash tanks is continuously recirculated through filtration systems to ensure removal of all contaminants from the solutions. When such contaminants include oils or greases, such oils and greases may be removed from the cleaning solution by coalescing devices or other oil removing systems, such as skimmers. Further, when a rinse tank is incorporated in the cleaning system, the fluid within the rinse tank is also continuously recirculated and filtered to remove contaminants.

The conveyor system of the present invention includes rotary racks which cooperate with guides in each tank to ensure that parts being conveyed through the wash tanks and the rinse tanks are rotated so that all surface areas of the parts are directly subjected to the turbulent jet streams created therein.

In the preferred embodiments, the parts are carried within baskets which are automatically or manually loaded onto the racks of the conveyor system which are spaced relative to one another. The baskets are automatically locked within the racks at a loading station and locks for retaining the baskets are automatically released at a discharge station.

It is the primary object of the present invention to provide a parts washing system and method for washing parts which includes a continuous vertical conveyor for conveying parts to be cleaned and wherein the parts are rotated in carrier racks as the parts are subject to the cleaning action of at least one turbulent cleaning solution within a wash or cleaning tank. In some embodiments, the parts are also subjected to a cleaning solution within an ultrasonic wash or cleaning tank having an ultrasonic insert mounted therein.

It is also an object of the present invention to provide a parts washing system which allows a substantially continuous feed and discharge of parts to and from the cleaning system such that a maximum number of parts may be cleaned utilizing minimal floor space and minimal manual labor.

It is also an object of the present invention to provide a parts washing system which is environmentally compatible and which allows water-base cleaning solutions to be used and wherein the solutions are continuously recirculated and filtered thus assuring a complete removal of contaminates from the cleaning solutions during the operation of the cleaning system.

It is also an object of the present invention to provide a cleaning system which is efficient in preserving the detergent within the cleaning solutions such that little make-up detergent is necessary during prolonged periods of operation, thus saving costs on detergent supplies and also reducing the environmental impact from loss of cleaning solutions from the system.

It is yet another object of the present invention to provide a continuous conveyor parts washing and cleaning system wherein the parts to be cleaned are continuously rotated such that all surfaces of the parts are exposed to the cleansing action of turbulent fluid flow and/or ultrasonic shock waves within wash tanks of the system to thereby more uniformly remove contaminants from the parts.

BRIEF DESCRIPTION OF THE DRAWINGS

A better understanding of the invention will be had with reference to the attached drawings wherein:

FIG. 3 is an enlarged cross-sectional view taken along line 3—3 of FIG. 1;

FIG. 4 is an enlarged partial cross-sectional view taken along line 4—4 of FIG. 3.

DESCRIPTION OF THE PREFERRED EMBODIMENT

Figure 1:
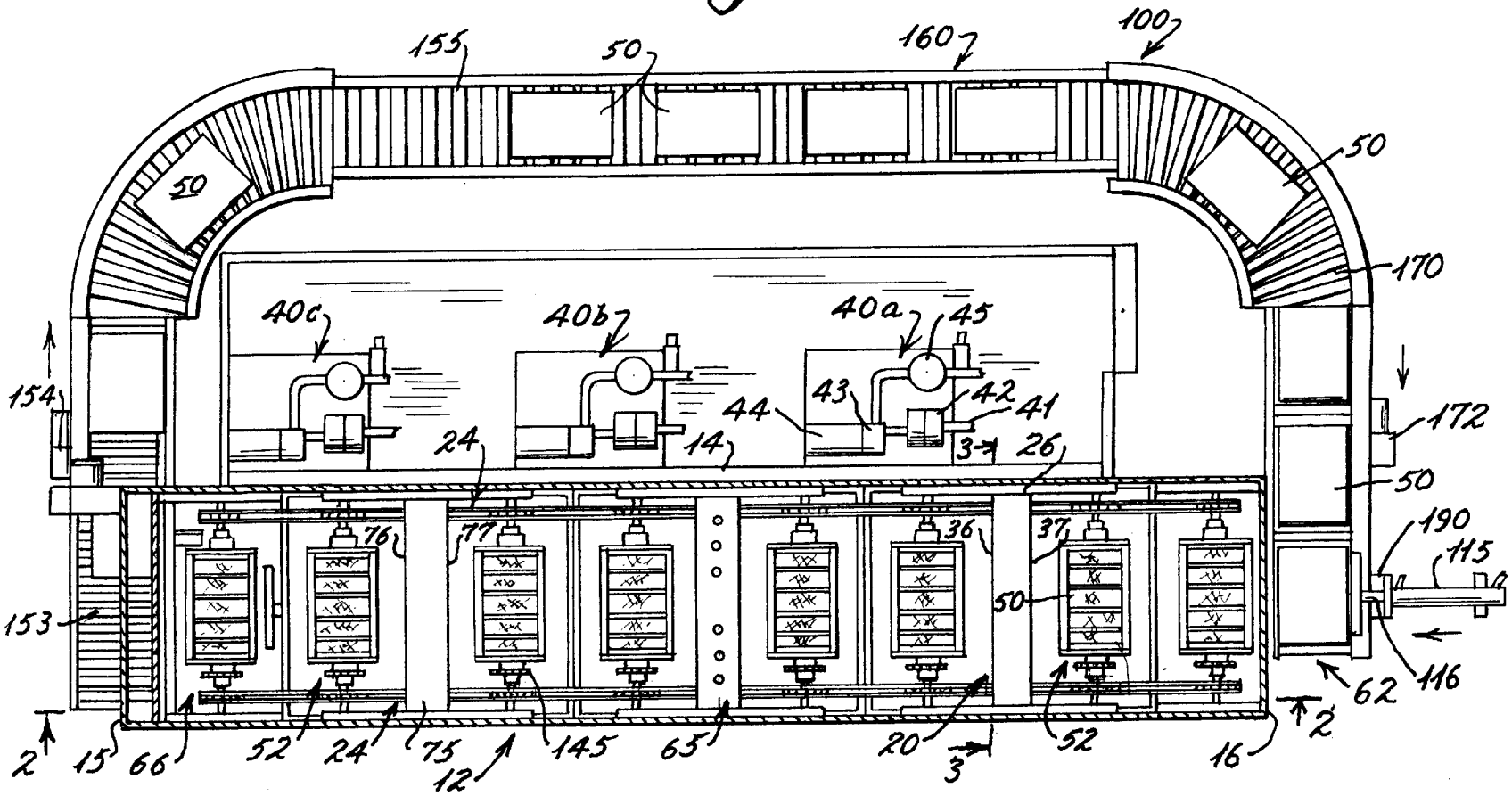
FIG. 1 is a top plan view of one embodiment of parts washing systems of the present invention.

With continued reference to the drawing figures, one embodiment of the parts washing system 10 of the present invention will be described incorporating a plurality of tanks for purposes of cleaning parts passing therethrough. It should be noted that the number of tanks and the types of solutions used in the tanks may be varied and remain within the teachings of the present invention. The system shown in the drawing figures includes an outer housing 12 having front and rear walls 13 and 14 and end walls 15 and 16. A steam cover or upper wall 18 may also be provided for purposes containing any steam or other vapors developed within the system. An appropriate vent system 19 may be provided which may include filters for removing any air entrained particulates or environmentally incompatible elements. The housing may not be used in all embodiments of the invention.

In the embodiment disclosed in the drawing figures, disposed within the outer housing 12 are a plurality of washing or cleaning tanks 20 and 22 and a rinse tank 24. Although three such tanks are shown in the drawing figures, the invention contemplates that additional tanks may be utilized either for washing, coating or dipping of mechanical parts or for further treating mechanical parts following cleaning. Further, systems can be designed incorporating a single wash tank, such as 20 or 22, combined with or without a rinse tank 24 or plural tanks 20 or 22 may be combined in a system with or without rinse or other tanks 24.

In the embodiment shown, wash tank 20 contains a water-base detergent cleaning liquid which is continuously recirculated and injected under pressure through a distribution header 26 mounted generally centrally of the tank. The tank is designed as a turbo-washer and detergent solution within the tank is continuously recycled through the discharge header 26 by use of a turbo-charger 27 mounted within a housing 28 in which a rotor or propeller 29 is disposed. The rotor is driven through a pulley and bearing assembly 30 connected by a drive belt 31 to a motor 32 mounted adjacent to an upper portion of the wash tank 20. The turbo-charger draws cleaning solution from the wash tank in the direction of the arrows shown in FIG. 3 upwardly into the turbo-charger housing where it is discharged at high pressure downwardly into the interior of the discharge header 26. From there, the cleaning solution is forced out at substantial pressure through openings 35 formed in the opposing side walls 36 and 37 of the distribution header 26 and into the main bath within the wash tank thereby creating very turbulent streams through which parts to be cleaned are conveyed. As shown, the discharge header is closed at its upper end and is generally filled with the cleaning solution from within the wash tank. Because of the substantial agitation and turbulence created by the turbo-charging mechanism of the present invention, it is possible to effectively use water-base cleaning solutions within the wash tank 20. However, it is also possible to use other types of detergents for purposes of cleaning parts.

As previously noted, the opposite side walls 36 and 37 of the discharge header 26 are oriented towards the opposing side walls of the wash tank 20. The opposite side walls include a plurality of the flow directing slots or openings 35 therein. Although the slots shown in the drawings are generally rectangular, the slots may take any configuration and orientation such that the openings are designed to direct washing solution at different angles from the discharge header outwardly into the wash tank. As opposed to slots or openings, nozzles may also be positioned along the opposite side walls of the discharge header to direct liquid discharge therefrom into the wash tank. It is important that the orientation and configuration of the fluid directing slots, nozzles or other fluid directing means associated with the discharge header be designed so as to create a predetermined discharge pattern of fluid flow therefrom and into the area of the wash tank between the discharge header and the side walls of the wash tank so as to effectively clean parts being conveyed therethrough. The openings are shown as extending along a substantial height of both of the side walls 36 and 37 of the discharge header.

To prevent build-up of contaminants within the wash tank 20, as well as the wash tank 22 and the rinse tank 24, each tank of the present invention includes a filtration system 40*a*, 40*b* and 40*c*, as shown in FIG. 1. Each filtration system is essentially the same and therefore only the system affiliated with the wash tank 20 will be discussed in specific detail. As shown in FIGS. 1, 3 and 4, situated along the lower portion of tank 20 is a discharge outlet 41 which extends to a pump 43 driven by a motor 44. The pump draws liquid through a strainer 42 and thereafter through a filter unit 45. Wash solution passing through the filter 45 is redirected or introduced into the wash tank through a fluid inlet 46 provided adjacent the lower portion of the wash tank. The inlet 46 includes a plurality of spaced nozzles 47 extending from a distribution pipe or manifold 48 disposed within the wash tank. The nozzles are oriented so as to direct fluid flow, and thus any contaminants, toward the fluid outlet 41, thereby ensuring that particles within the wash solution and other contaminants are effectively removed by the filtration system 40*a*.

Many manufactured parts are contaminated with chips, fines, and other materials, in addition to the residual machining oil. These contaminants must also be removed to extend the useful life of the cleaning solution. Most contaminants will be held in suspension by the turbulent cleaning fluid, but many chips and heavier fines will settle to the bottom of the cleaning tank even while the tank fluid is being agitated. A build-up of such metals at the bottom of the tank can result in serious problems if not removed periodically. For example, fluid heater elements 49 may be used to heat the cleaning solution. These elements are located near the bottom of the tank and a build up of metal particles at the bottom could interfere or disable the heaters. Further, some materials after an extended exposure to a hot environment will solidify and become very difficult to remove. The present invention is designed to prevent such build-up of solids by pumping fluid from the tank toward the outlet 41 at a bottom corner, straining and filtering the solution, as previously discussed, and returning the solution, under pressure, to the internal tank manifold 48 located at the bottom of an adjacent corner. The internal tank manifold is routed around the tank floor along the two tank walls opposite the filter outlet. Both sections are equipped with the nozzles 47, each pointed toward the filter outlet 41. The return flow provides sufficient fluid current along the bottom of the tank to sweep chips and heavier particles to the outlet where they are removed, along with suspended contaminants, by the filtration circuit pump.

As noted, it is also preferred to elevate the temperature of the cleaning solution "S" within the wash tank. In this respect, one or more immersion heating elements 49 are mounted to extend into the wash tank adjacent the lower portion thereof, as is shown in FIG. 3. Each tank of the invention may include similar heating elements.

Figure 2:
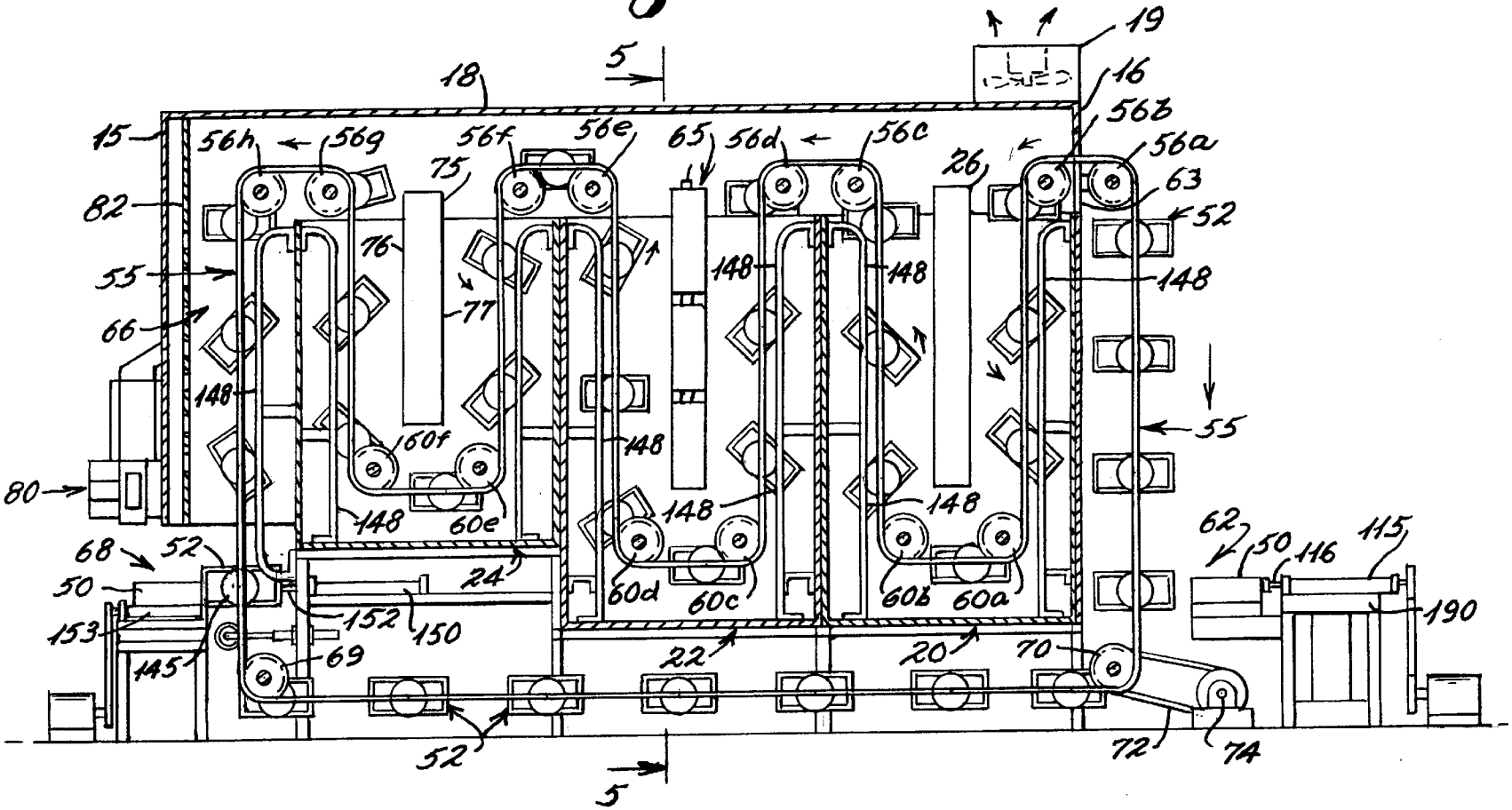
FIG. 2 is a cross-sectional view taken along lines 2—2 of FIG. 1.

The parts to be cleaned within the tank 20 are conveyed by appropriate containers or baskets 50 which are carried by support racks 52 which are mounted in spaced relationship relative to one another to a pair of endless chains 53 and 54 of an endless conveyor system 55. The manner in which the racks are mounted to the chains of the conveyor system 55 will be discussed in greater detail hereinafter. The chains are guided over a plurality of double sprocket support assemblies. With reference to FIG. 2, eight such double sprocket assemblies are shown at 56*a*, 56*b*, 56*c*, 56*d*, 56*e*, 56*f*, 56*g* and 56*h*, above the tanks 20, 22 and 24. Each sprocket assembly which includes a pair of sprockets 57 and 58 which are freely rotatably mounted to a support shaft 58. Each of the double sprocket assemblies 56 is mounted to a reinforcing frame adjacent the upper portion of the housing 12. In addition, the conveyor system also includes two double sprocket assemblies 60*a*, 60*b*, 60*c*, 60*d*, 60*e* and 60*f* mounted in spaced relationship within each of the wash tanks 20 and 22 and the rinse tank 24. Each of the lower double sprocket assemblies also include a pair of sprockets idly mounted on a shaft connected to or through the side walls of each of the respective wash or rinse tanks. In this manner, the two chains of the conveyor system follow a serpentine vertical path, first upwardly from a loading station 62, shown in FIG. 2, through an opening 63 in the side wall 16 of the housing and over first and second double sprocket assemblies 56*a*, 56*b*. The chains then pass downwardly through the wash tank 20 such that the conveyor passes intermediate the discharge header 26 and a side wall of the wash tank. Thereafter, the endless conveyor is redirected horizontally by first and second lower double sprocket assemblies 60*a*, 60*b* and thereafter upwardly such that the vertical conveyor run extends intermediate an opposite side wall of wash tank 20 and the discharge header 26. The conveyor thereafter passes over upper double sprocket assemblies 56*c*, 56*d* and downwardly so as to be intermediate an ultrasonic insert 65 which is mounted within the ultrasonic washing tank 22 and a side wall thereof. The conveyor thereafter passes around lower double sprocket assemblies 60*c* and 60*d* and then upwardly over a pair of double sprockets 56*e* and 56*f* and again downwardly about lower double sprocket assemblies 60*e* and 60*f* mounted within the lower portion of the rinse tank. Thereafter, the conveyor extends upwardly over another pair of double sprocket assemblies 56*g* and 56*h*, afterwhich the endless conveyor extends downwardly through a drying chamber 66 to a discharge station 68. After passing through the discharge station 68, the conveyor extends about a first lower double sprocket assembly 69 and horizontally beneath the rinse and wash tanks back to a double drive sprocket assembly 70 adjacent the loading station 62. The drive socket assembly 70 is connected by a drive chain or belt 72 to an appropriate motor 74.

From the foregoing description, it should be noted that the various vertical runs of the conveyor provide two passes of all parts being carried by the conveyor through each of the wash tanks 20 and 22 and the rinse tank 24. The vertical runs extend intermediate the discharge header 26 and the opposite side walls of the wash tank 20 and intermediate the ultrasonic insert 65 of the ultrasonic cleaning tank 22 and the opposite side walls thereof and intermediate a discharge header 75 provided generally centrally in the rinse tank 24, which header is substantially the same structure as disclosed with respect to discharge header 26. The discharge header 75 is provided with a turbo-charger and fluid is directed outwardly on opposite sides 76 and 77 of the discharge header toward the opposite side walls of the rinse tank 24.

One of the benefits of the present invention is that the conveyor assembly can be expanded vertically. Also, the wash tanks and rinse tanks may also be extended vertically and thus additional cleaning capacity can be obtained without requiring additional floor space to be consumed.

To at least partially dry parts being cleaned and rinsed utilizing the system of the present invention, a blower assembly 80 is mounted along the last vertical conveyor run adjacent to the discharge station 68. The blower directs a stream of heated or non-heated air through a diffuser panel 82 such that the air is directed against parts before they reach the discharge station.

Figure 5:
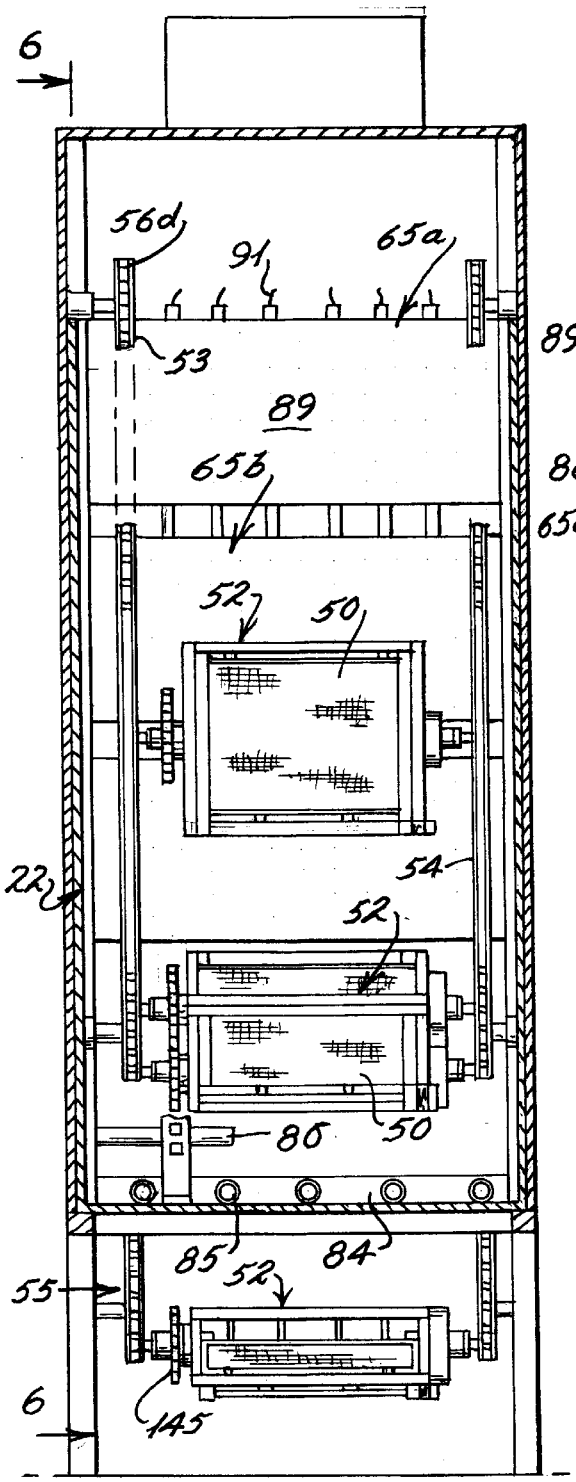
FIG. 5 is a partial cross-sectional view taken along line 5—5 of FIG. 1.
Figure 6:
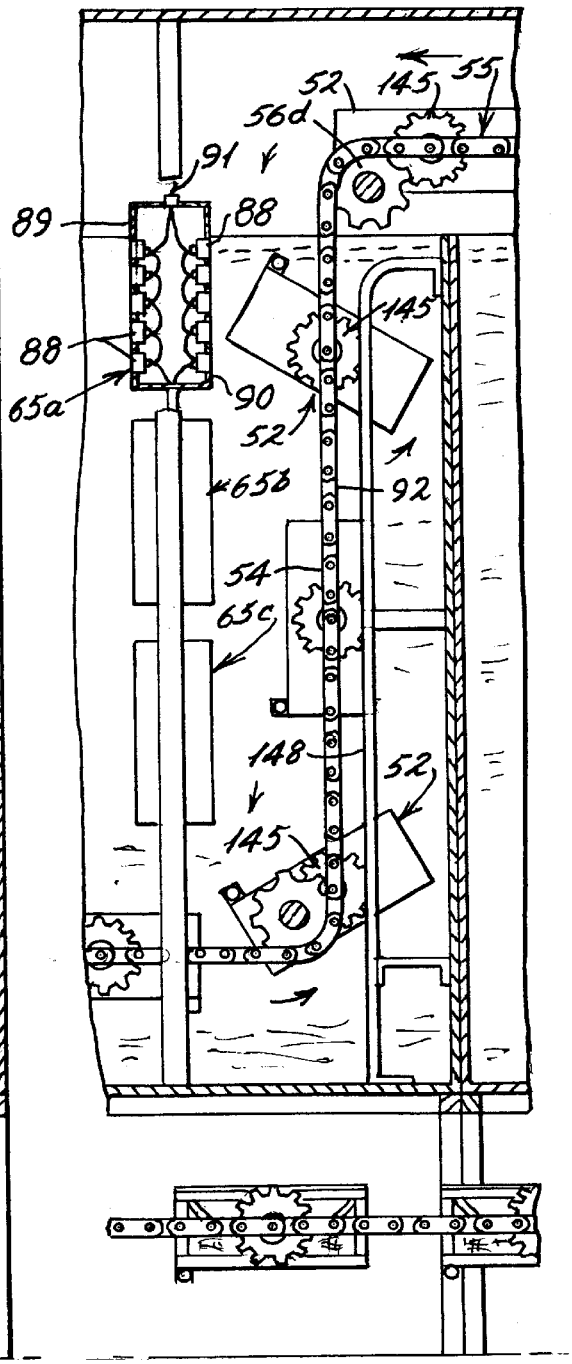
FIG. 6 is a cross-sectional view taken along line 6—6 of FIG. 5.

With continued reference to FIGS. 5 and 6, the details with respect to the ultrasonic cleaning tank 22 are shown.

The cleaning solution "S" within the tank is recirculated and filtered as previously discussed with respect to the turbulent wash tank 20 utilizing the filtration system 40*b*. Fluid is introduced into the tank 22 through a fluid header 84 having a plurality of nozzles 85 associated therewith. Also, the solution may be heated utilizing an immersion heater 86. The ultrasonic insert 65 consists of a plurality of individual transducer housings 65*a*, 65*b* and 65*c*, which are mounted centrally of the tank 24. In order to show the manner in which the transducers are mounted within each of the housings, the transducer housing 65*a* is shown in cross section in FIG. 6. A plurality of rows of transducers 88 are mounted against each of the side walls 89 and 90 of the housing and are electrically connected by appropriate conductors 91 to an external electronic generator (not shown). The ultrasonic generator produces frequencies in the 20 kHz to 100 kHz range, typically about 27 kHz. The power output frequency of the generator is determined by the type and size of the parts to be cleaned.

As the ultrasonic transducers 88 are secured to the opposite sides of each of the ultrasonic insert housings 65*a*, 65*b* and 65*c*, they transfer the ultrasonic motion to both sides of each housing and from there to the wash solution within the tank 22. A sound wave in the wash solution has a high pressure ahead of it and low pressure in back of it. As the sound waves pass through the solution, the pressure can reach a value below that of the liquid cohesive forces and thereby produce numerous small empty cavities in the liquid. Some of these small cavities have such a size that they enter into resonance with the frequency of the sound waves. Thus, the cavities begin to oscillate and collapse releasing strong shock waves. In a high intensity cavitation field, bubbles implode millions of times per minute and release powerful shock waves that impinge against any submerged object in the liquid. These shock waves provide the scrubbing action in the ultrasonic cleaning tank.

Utilizing the vertical conveyor system, the parts being conveyed through the ultrasonic cleaning tank are handled in such a manner that one side of the parts will be directly oriented toward the transducer insert housings 65*a–c* when passing through a first vertical run, such as shown at 92 in FIG. 6, but will be reoriented so that the opposite side of the parts is oriented towards the opposite side walls of each of the housings 65*a–c* when being elevated upwardly in another conveyor run from the tank 22, as shown in FIG. 2.

The manner in which the parts are rotated so as to ensure the proper and sequential orientation of different sides thereof with respect to the ultrasonic transducer inserts will be described in greater detail. The conveyor system 55, as previously noted, includes a plurality of spaced rotator racks 52 mounted thereto. The details of the rotator racks are shown in FIGS. 7 thru 12. The rotator racks are designed to selectively receive enclosed open wire, mesh or other perforated side wall baskets or containers 50. The structure of the baskets may be varied as is needed. The baskets are designed to have a removable lid and receive loose parts which may be manually or automatically loaded as the baskets pass along a loading conveyor 100 associated with the cleaning system 10. The parts baskets are specifically constructed to allow maximum flow of cleaning solution therethrough and yet securely retain the parts therein.

Figure 7:
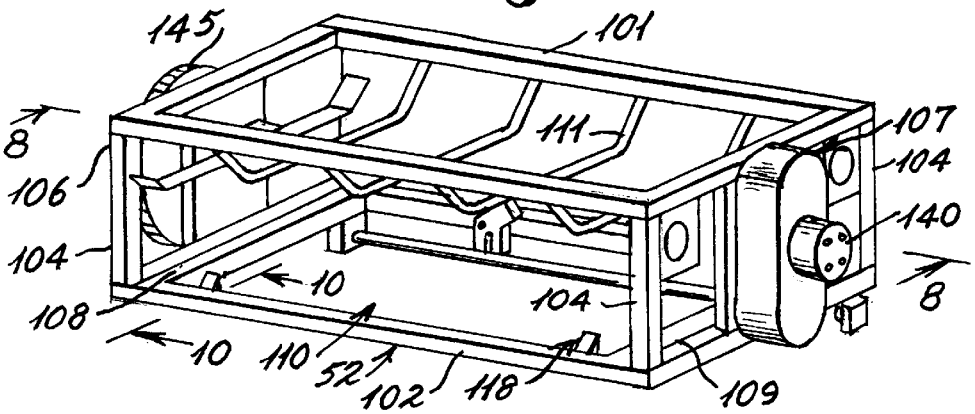
FIG. 7 is a front perspective view of a parts basket retention rack of the invention.

Each rotator rack includes upper and lower generally open and rectangular frames 101 and 102 which are interconnected by a plurality of vertical brace members 104 which extend therebetween along the sides 106 and 107 of each rack. The interior of the rack is generally open, as shown in FIG. 7. The lower frame 102 defines side support flanges 108 and 109 on which the bottom of a basket 50 is selectively seated when loaded into the rack. Each rack is specifically designed to allow loading of a basket 50 into a first side 110 thereof and to allow discharge of the basket from an opposite side 112.

Figure 10:
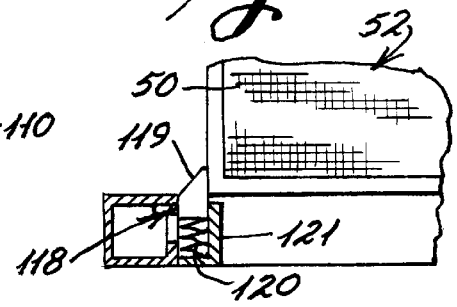
FIG. 10 is a partial cross-sectional view taken along line 10—10 of FIG. 7.

With specific reference to FIG. 2, when a basket 50 is conveyed to the loading station 62 and when one of the racks 52 is aligned with the basket at the loading station, the conveyor controls will automatically stop the conveyor. At this time, a basket 50 may be loaded by inserting the basket into the side 110 of the aligned rack. The loading may be done manually or automatically. In the drawing figures, a pneumatic or hydraulic cylinder 115 is shown having a ram portion 116 for engaging a basket 50. By activation of the ram, the basket is forced into the aligned rack. As the basket 50 is entering the rack, one or more lock mechanisms 118 are engaged, as shown in FIG. 10. The locks include beveled upper edges 119 which are engageable by the advancing basket such that the basket, when engaging the beveled edges, will force the lock members downwardly against springs 120 mounted within housings 121. As soon as the baskets have passed beyond the locks 118, the locks will automatically be raised vertically by the springs 120 thereby preventing the withdrawal of the baskets through the side 110 of the rack. When the baskets are loaded, bars 111 of the racks will engage lids on the baskets thereby securely retaining the baskets in place.

Figure 8:
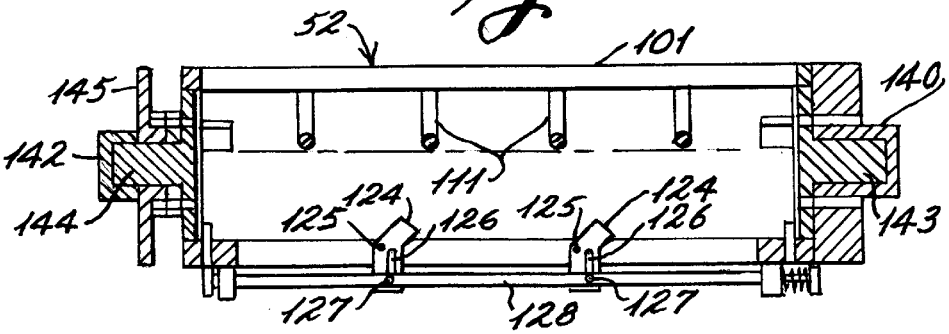
FIG. 8 is a partial cross-sectional view taken along line 8—8 of FIG. 7.
Figure 9:
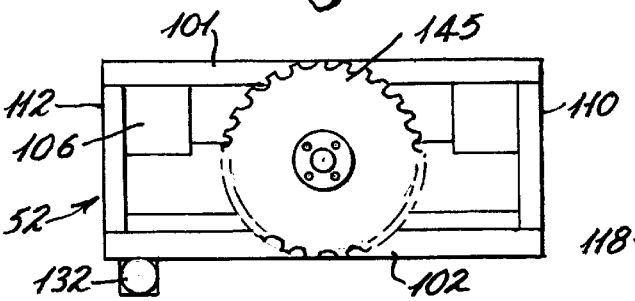
FIG. 9 is a view taken from the right side of the rack of FIG. 7.
Figure 11:
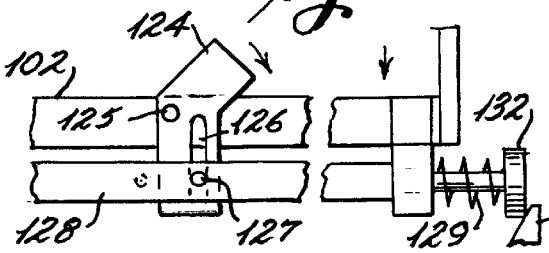
FIG. 11 is an illustrational view of a basket lock release mechanism of the invention.
Figure 12:
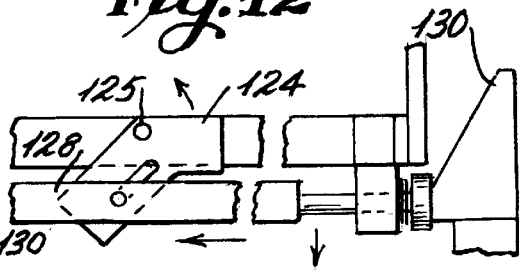
FIG. 12 is a view similar to FIG. 11 showing the lock released.

To retain a baskets within a rack and to prevent the premature discharge of a basket from the opposite side 112 of the rack, one or more stop tabs 124 are pivotally mounted at 125 to the lower frame 102 adjacent the discharge side 112 of the rack. The tabs 124 have elongated vertical slots 126 therein in which pins 127, mounted through an actuator bar 128, are guidingly received. The actuator bar 128 is spring loaded at 129 so as to be normally retained in a position as shown in FIG. 8 wherein the tabs extend upwardly to prevent the passage of a basket 50 outwardly of the side 112 of the rack. As shown in FIGS. 11 and 12, however, as a rack with a basket therein approaches the discharge station 68, an unlocking mechanism 130, mounted to the frame of the washer adjacent to the conveyor 55, is engaged by an end portion 132 of the control rod 128. During this engagement, the actuator bar 128 is moved to the left, as shown in FIG. 12, such that each of the tabs 124 are pivoted as shown by the arrows in the drawings and no longer obstruct the movement of the basket from the side 112 of the rack. At this point, the basket may be manually unloaded at the discharge station or, as shown in FIG. 2, a pneumatic or hydraulic cylinder or electric motor 150 is activated to move a discharge ram 152 to thereby push the basket from the rack and onto a discharge conveyor 153. Movement of the conveyor 55 is prevented until the ram 152, associated with the discharge cylinder 150, is retracted from the aligned rack 52. Thereafter, when the conveyor 55 begins movement, the locking tabs will automatically be elevated to their raised position as shown in FIG. 11 as the locking bar moves to the right causing the pivoting motion.

Each of the racks of the present invention is designed to be rotatable relative to the spaced chains of the conveyor system 55 so that the baskets 50 mounted thereon may be selectively rotated during the passage of the baskets through the cleaning tanks 20 and 22 and rinsing tank 24. To accomplish this, each rack includes a pair of spindle housings 140 and 142 which are adapted to be secured by mounting bolts or screws to the chains of the conveyor system. Secured at each end of the rack are fixed spindles 143 and 144 which are rotatably mounted within the fixed spindle housings 140 and 142, respectively. Fixedly mounted to spindle 144 is a toothed sprocket 145.

To control the rotation of the racks 52 within the tanks 20, 22 and 24, a plurality of slotted rails 148, such as shown at FIG. 6, are mounted within the tanks. Each of the rails includes a plurality of spaced openings in which the teeth of the sprockets 145 of each of the racks 52 is engageable. As shown in FIGS. 2 and 6, as the conveyor chains move within each tank, the teeth of the sprockets 145 will cause rotation of the racks 52 such that the racks are oriented with one side of the racks facing the center of each tank when descending through a given tank and such that the opposite side of each rack will face the center of each tank when ascending. In this matter, both sides of any parts retained within the baskets 50 will be oriented toward either the discharge headers associated with tanks 20 and 24 or the sonic inserts associated with the ultrasonic cleaning tank 22. A further slotted channel is provided along the drying chamber 66 for purposes of rotating the baskets relative to the air discharged header 82. Parts with blind holes may have chips or contaminants that must be removed in the cleaning process. By placing the parts in baskets or other holding devices and rotating them within the cleaning solutions and the rinsing solutions, all part surfaces are exposed to the scrubbing action of the cleaning solutions. Rotation also empties any chips from such blind holes and continued rotation above each tank also allows liquid to drain from the blind holes while preventing liquid carry-over from one tank to the next tank or to a subsequent stage, such as the drying chamber 66.

As previously discussed, once a basket has been conveyed through the entire washing system, the baskets are discharged onto a discharge conveyor 153 located adjacent to the discharge station 68. The conveyor 153 is a continuous conveyor driven by a motor assembly 154. From the power conveyor 153, the empty baskets traverse an unpowered gravity conveyor 155 to a packing area generally designated at 160. At the packing area parts to be cleaned are placed within the baskets and the baskets are then urged onto a feed conveyor 170 powered by a motor 172 which conveys the baskets to the loading station 62.

The system disclosed and shown in the drawing figures has the loading station mounted at one end of the system and the discharge station at the opposite. The system may also function by providing both the loading station and the discharge station at the same end of the cleaning system. To accomplish this, the racks of the present invention need only be designed to be loaded and unloaded from the same side. The same mechanics which are associated with the racks previously described can be modified to accomplish this purpose. Further, as also previously discussed, the baskets may be manually loaded and unloaded with respect to the basket carrier racks 52 of the cleaning system.

In operation, a basket 50 having parts to be cleaned therein is initially conveyed by feed conveyor 170 to the loading station 62. The loading conveyor is driven by a motor assembly 172. A sensor 190 detects the presence of a basket rack at the loading station 62 and is operational to stop power to the conveyor drive motor 74. A separate sensor (not shown) may be utilized to ensure proper alignment of the basket at the loading station. Thereafter, the hydraulic or pneumatic cylinder 115 is activated to force the ram 116 to load the basket 50 into the aligned rack 52. The basket is automatically locked into position as previously discussed. Once the basket has been loaded, the motor 74 is reactivated and the conveyor system 55 indexed until the next carrier rack is aligned at the loading station, at which time the drive motor 74 is terminated to await the loading of a subsequent parts retaining basket.

The loaded racks are first conveyed into the turbulent wash chamber 20 where the baskets are rotated as previously discussed. Parts within each basket are subjected to the turbulent flow coming from the discharge header 26. The parts are oriented in one direction as they descend within the tank 20 and are reoriented so that the opposite sides thereof are facing the outlet openings 35 in the discharge header 26 as they ascend through the cleaning solution. The racks with the loaded baskets thereafter descend and ascend sequentially through the cleaning solution within the ultrasonic cleaning tank 22 where again, the parts are oriented in a first direction during their descent though the tank and are reoriented in a different direction as they ascend through the ultrasonic cleaning tank. The parts are thereafter conveyed to the rinse chamber 24 where again the parts are subjected to the turbulent discharge of fluid from the discharge header 75 with the parts being oriented in a first direction during descent into the rinsing solution and reoriented in an opposite direction during ascent from the rinsing solution. The parts are thereafter conveyed as they are rotated through the drying chamber 66. The movement of the conveyor is in an indexed motion to allow loading and discharging of baskets from the carriers. At the discharge station 68, the locking tabs 124 associated with an aligned rack 52 are released and the pneumatic or hydraulic cylinder 150 is activated to force the basket with cleaned parts onto the discharge conveyor 153.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A parts washing system comprising;

at least one wash tank adapted to retain a cleaning solution therein, means mounted generally centrally of said at least one wash tank for creating turbulence of a cleaning solution within said wash tank directed toward opposite side walls of said wash tank, an endless conveyor extending from a parts loading station to a parts discharging station, said endless conveyor including at least first and second vertical runs extending through said at least one wash tank with said first and second vertical runs extending on opposite sides of said means for creating turbulence within said at least one wash tank, a plurality of means for carrying parts mounted in spaced relationship to said endless conveyor, and said means for carrying parts being rotatably mounted to said endless conveyor whereby parts carried thereby are rotated as said parts pass along said first and second vertical runs within said at least one wash tank.

2. The parts washing system of claim 1, including means for filtering a washing solution within said at least one wash tank, said means for filtering including pump means for recirculating the cleaning solution from said at least one wash tank through a filter and thereafter returning filtered wash solution to said at least one wash tank.

3. The parts washing system of claim 2 wherein each of said means for carrying parts to be cleaned includes a carrier rack, said endless conveyor including a pair of spaced conveyor chains, means for rotatably mounting opposite ends of each of said racks to said pair of chains.

4. The parts washing system of claim 3 further including a sprocket mounted to at least one side of each of said carrier racks, and means mounted within said at least one wash tank adapted to be engageable by said sprocket of each of said carrier racks for thereby rotating said carrier racks by cooperative engagement with said sprockets with said means engageable by said sprockets.

5. The parts washing system of claim 4 in which said means engageable by said sprockets includes at least one rail member having a plurality of spaced openings therein, each of said sprockets including teeth extending therefrom for engagement within said openings of said at least one rail member.

6. The parts washing system of claim 3, including a basket defined by porous side walls selectively receivable within said carrier racks, and each of said carrier racks including means for locking said baskets within said carrier racks.

7. The parts washing system of claim 6, including means adjacent said parts discharging station for releasing said locks to permit withdrawal of said baskets from said carrier racks.

8. The parts washing system of claim 7, including means mounted adjacent said parts loading station for loading a basket into an aligned carrier rack.

9. The parts washing system of claim 7, including means mounted adjacent said parts discharging station for discharging a basket from a carrier rack.

10. The parts washing system of claim 1, including a plurality of wash tanks, at least one of said plurality of said wash tanks including a central discharge header, turbocharger means mounted within said at least one of said plurality of wash tanks for recirculating cleaning solution into said discharge header, and means in opposite side walls of said discharge header for directing fluid flow outwardly therefrom towards said opposite side walls of said at least one of said plurality of wash tanks.

11. The parts washing system of claim 10 in which at least one of said plurality of wash tanks includes means for creating turbulence within said at least one wash tank includes an ultrasonic insert, said ultrasonic insert including a plurality of transducer elements oriented in opposite directions towards said opposite side walls of said at least one wash tank, and means for electrically connecting each of said transducers to a source of power.

12. The parts washing system of claim 10 wherein said endless conveyor includes at least two vertical runs within said at least one of said plurality of wash tanks, said at least two vertical runs being on opposite sides of said discharge header.

13. The parts washing system of claim 12 wherein each of said means for carrying parts to be cleaned includes a carrier rack, said endless conveyor including a pair of spaced conveyor chains, means for rotatably mounting opposite ends of each of said racks to said pair of chains.

14. The parts washing system of claim 13 further including a sprocket mounted to at least one side of each of said carrier racks, and means mounted within said at least one of said plurality of wash tanks adapted to be engageable by said sprocket of each of said carrier racks for thereby rotating said carrier racks by cooperative engagement with said sprockets with said means engageable by said sprockets.

15. The parts washing system of claim 14 in which said means engageable by said sprockets includes at least one rail member having a plurality of spaced openings therein, each of said sprockets including teeth extending therefrom for engagement within said openings of said at least one rail member.

16. The parts washing system of claim 12, including a rinse tank, said endless conveyor including at least two vertical runs extending through said rinse tank, and means for rotating said carrier racks within said rinse tank.

17. The parts washing system of claim 16, including means for at least partially drying parts being discharged from said rinse tank.

18. The parts washing system of claim 12 in which at least one of said plurality of wash tanks includes means for creating turbulence within said at least one wash tank includes an ultrasonic insert, said ultrasonic insert including a plurality of transducer elements oriented in opposite directions towards said opposite side walls of said at least one wash tank, and means for electrically connecting each of said transducers to a source of power.

19. The parts washing system of claim 1, including a rinse tank, said endless conveyor including at least two vertical runs extending through said rinse tank, and means for rotating said carrier racks within said rinse tank.

20. The parts washing system of claim 19, including means for at least partially drying parts being discharged from said rinse tank.

* * * * *